US005747208A

United States Patent [19]

Ueda

[11] Patent Number: 5,747,208

[45] Date of Patent: May 5, 1998

[54] METHOD OF USING PHOTOSENSITIVE MEMBER COMPRISING THICK PHOTOSENSITIVE LAYER HAVING A SPECIFIED MOBILITY

[75] Inventor: Hideaki Ueda, Kishiwada, Japan

[73] Assignee: Minolta Co., Ltd., Osaka, Japan

[21] Appl. No.: 908,610

[22] Filed: Aug. 8, 1997

Related U.S. Application Data

[60] Continuation of Ser. No. 650,554, May 20, 1996, abandoned, which is a division of Ser. No. 418,900, Apr. 7, 1995, abandoned, which is a continuation of Ser. No. 171,447, Dec. 22, 1993, abandoned.

[30] Foreign Application Priority Data

Dec. 28, 1992 [JP] Japan ..... 4-348453
Dec. 1, 1993 [JP] Japan ..... 5-301987

[51] Int. Cl.[6] ..... G03G 13/06; G03G 5/047

[52] U.S. Cl. ..... 430/97; 430/58

[58] Field of Search ..... 430/58, 69, 126, 430/97

[56] References Cited

U.S. PATENT DOCUMENTS

| | | | |
|---|---|---|---|
| 4,346,157 | 8/1982 | Kakuta et al. | 430/58 |
| 4,670,369 | 6/1987 | Nakagawa et al. | 430/57 |
| 4,702,981 | 10/1987 | Matsumoto et al. | 430/69 |
| 4,956,256 | 9/1990 | Ohtsuka et al. | 430/96 |
| 5,120,627 | 6/1992 | Nozomi et al. | 430/59 |
| 5,173,384 | 12/1992 | Otsuka | 430/59 |
| 5,294,509 | 3/1994 | Ashiya et al. | 430/58 |
| 5,316,880 | 5/1994 | Pai et al. | 430/58 |
| 5,328,790 | 7/1994 | Asano et al. | 430/65 |
| 5,376,485 | 12/1994 | Yoshihara | 430/58 |
| 5,397,395 | 3/1995 | Sano et al. | 118/718 |
| 5,532,101 | 7/1996 | Nozawa et al. | 430/126 |

FOREIGN PATENT DOCUMENTS

| | | |
|---|---|---|
| 2-46937 | 11/1990 | Japan . |
| 4-220651 | 8/1992 | Japan . |

OTHER PUBLICATIONS

Diamond, Arthur S. (editor). Handbook of Imaging Materials. New York: Marcel-Dekker, Inc. pp. 160–163, 406–411, 1991.

IBM Engineering Specification 890350, Mar. 1970.

Diamond, Arthur S. (1991) *Handbook of Imaging Materials*. New York: Marcel-Dekker, Inc. pp. 387–392, 427–434, 439.

*Primary Examiner*—Christopher D. Rodee

*Attorney, Agent, or Firm*—Burns, Doane, Swecker & Mathis, LLP

[57] ABSTRACT

The present invention provides a laminated-type photosensitive member comprising a photosensitive layer which is comprised of a charge generating layer containing an organic charge generating material and a charge transporting layer having a thickness of at least 27 μm and containing an organic charge transporting material on an electrically conductive cylindrical substrate having a small drum size.

a mobility (μ) of electrical charges in the charge transporting layer has a specified value. The laminated-type photosensitive member can be applied to an image-forming process in which electrostatic latent images are formed at the identical position of the photosensitive member at a 0.5 or less second interval.

13 Claims, 1 Drawing Sheet

METHOD OF USING PHOTOSENSITIVE MEMBER COMPRISING THICK PHOTOSENSITIVE LAYER HAVING A SPECIFIED MOBILITY

This application is a continuation, of application Ser. No. 08/650,554, filed May 20, 1996 abandoned, which is a divisional of application Ser. No. 08/418,900, filed Apr. 7, 1995 abandoned, which is a continuation of application Ser. No. 08/171,447, filed Dec. 22, 1993 abandoned.

BACKGROUND OF THE INVENTION

1. Field of the Invention

The present invention relates to a photosensitive member of a laminated-type having a charge generating layer and a charge transporting layer, in particular to a photosensitive member having a thick charge transporting layer, which is excellent in wear resistance and electrical characteristics.

2. Description of the Prior Art

Known photosensitive materials for forming a photosensitive layer include inorganic photoconductive materials such as selenium, cadmium sulfide or zinc oxide. These photosensitive materials have many advantages such as low loss of charges in the dark, an electrical charge which can be rapidly dissipated with irradiation of light and the like. However, they have disadvantages. For example, a photosensitive member based on selenium is difficult to produce, has high production costs and is difficult to handle due to inadequate resistivity to heat or mechanical impact. A photosensitive member based on cadmium sulfide has defects such as its unstable sensitivity in a highly humid environment and loss of stability with time because of the deterioration of dyestuffs, added as sensitizer, by corona charge and fading with exposure. These photosensitive members also have a problem from the viewpoint of safety.

Many kinds of organic photoconductive materials such as polyvinylcarbazole and the similar compounds have been proposed for forming an organic photosensitive layer. These organic photoconductive materials have superior film forming properties, are light in weight, etc., but inferior in sensitivity, durability and environmental stability compared to the aforementioned inorganic photoconductive materials.

Various studies and developments have been in progress to overcome the above noted defects and problems. A function-divided organic photosensitive member of a laminated or a dispersed type has been proposed, in which a charge generating function and a charge transporting function are shared by different compounds. In usual, a photosensitive layer in the function-divided photosensitive member of the laminated type is composed of a charge generating layer containing an organic charge-generating material, a charge transporting layer containing an organic charge-transporting material and a binder resin. A photosensitive layer in the function-divided photosensitive member of the dispersion-type is composed of an organic charge-generating material and an organic charge-transporting material which are dispersed in a binder resin.

Such a function-divided organic photosensitive member can display performances excellent in electrophotographic properties such as chargeability, sensitivity, residual potential, durability with respect to copy and repetition, because most adequate materials can be selected from various materials. Moreover, function-divided photosensitive members have high productivity and low costs, since they can be prepared by coating, and suitably selected charge generating materials can freely control a region of photosensitive wavelength.

However, the organic photosensitive member is generally poor in mechanical strength and durability compared to the inorganic photosensitive member. A thickness of the organic photosensitive member decreases with its friction against toner, paper, a cleaning member and other similar loads in the copying machine. A layer-decreasing degree caused by wear depends on materials and mechanical systems, but generally it is 0.2–1 μm after 10,000 times of copy. The decrease of the layer-thickness causes the deterioration of chargeability. When the deterioration is beyond tolerance limits, the lifetime of the photosensitive member is over. As a result, the organic photosensitive member is poor in resistance to copy.

Moreover a system speed of a copying machine has been made high recently. A load on a photosensitive member is so severe that the wear of the photosensitive member has been a serious problem.

Therefore, it has been developed and researched that a charge transporting layer in a photosensitive layer of a laminate-type is made thick in order to improve durability and to make the lifetime of the photosensitive member long.

However when a thickness of the charge transporting layer is merely made thick, it is true that the lifetime of the photosensitive member becomes long. However the increase of the layer thickness causes deterioration of electrical properties and accumulation of electrical charges, resulting in lowering of sensitivity. Particularly, in a photosensitive member having a small diameter of at most 50 mmΦ, the above tendency is more remarkable. Because when the photosensitive member having a small diameter is used repeatedly, electrostatic latent images are formed on an identical position in a short time, it is hard to quench generated charge carriers completely by an erasing light by the time of the next charging process. As a result, electrical carriers remain in the charge transporting layer or the charge generating layer to cause the increase of residual potential and the lowering of surface potential. Accordingly the thicker the transporting layer is, or the higher the system speed is by use of a small size photosensitive member, the higher mobility is required in the charge transporting layer and the charge generating layer in order to quench the surface charges in a short time.

SUMMARY OF THE INVENTION

The object of the present invention is to provide a laminated-type organic photosensitive member having a thick charge transporting layer of at least 27 μm, which is thicker than a conventional charge transporting layer of 10 to 20 μm.

The photosensitive member of the present invention has high sensitivity, the electrical characteristics are stable even after repetition use and an increase of residual potential is low in spite of such a thick charge transporting layer.

The present invention relates to a laminated-type photosensitive member comprising a photosensitive layer which is comprised of

- a charge generating layer containing an organic charge generating material and
- a charge transporting layer having a thickness of at least 27 μm and containing an organic charge transporting material
- on an electrically conductive cylindrical substrate having a small drum size.
- a mobility (μ) of electrical charges in the charge transporting layer has a specified value. The laminated-type photosensitive member can be applied to an image-forming process in which electrostatic latent images are formed at the identical position of the photosensitive member at a 0.5 or less second interval.

DETAILED DESCRIPTION OF THE INVENTION

Figure 1:
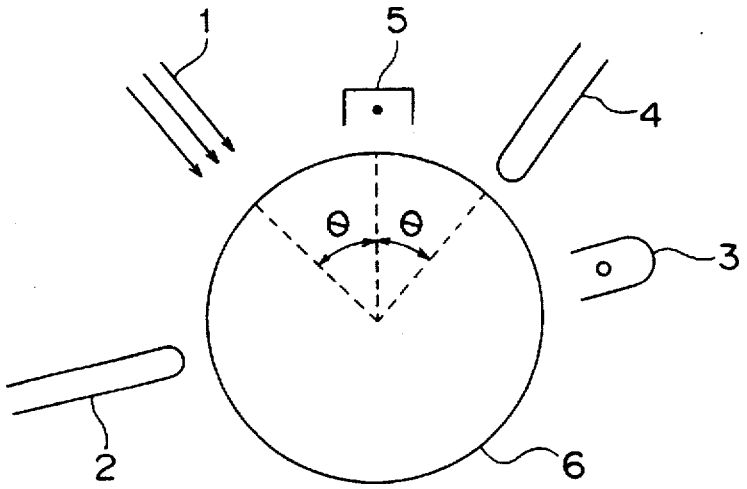
FIG. 1 is a schematic view of a tester for a photosensitive member.

The present invention relates to a photosensitive member having a thick charge transporting layer compared to a conventional photosensitive layer, which can be prevented from accumulation of electrical charges in a charge generating layer and a charge transporting layer, deterioration of sensitivity and increase of residual potential.

The present invention has accomplished the above object by forming a charge generating layer and a thick charge transporting layer having a specified mobility on an electrically conductive substrate having a small diameter.

The mobility (μ) in this invention represents a moving speed of charge carriers in the charge transporting layer or the charge generating layer. The larger the mobility is, the higher the moving speed of the electrical charges is. The mobility has a close connection with the accumulation of electrical charges.

The mobility is obtained from a transit-time on the basis of signals sent by Time of Flight Method (TOF), in which a charge transporting layer and a charge generating layer are formed on a NESA glass and gold is sputtered to form an electrode on the surface, followed by irradiation of a nitrogen laser of 337 nm wavelength at a pulse interval of 5 nsec through the NESA glass at 25° C.

In the present invention, the charge transporting layer is made thick to improve durability and the mobility in the transporting layer is adjusted within a specified range to prevent accumulation of electrical charges in the charge transporting layer. Thereby the lowering of chargeability and the increase of residual potential can be prevented.

In the formula $\log \mu = A \times E^{1/2} + B$ [I], the letters A and B can be determined as follows: a linear relationship between mobility (μ) and $E^{1/2}$ is obtained and the letter A represents an inclination of the linear line and the letter B represents an ordinate axiscrossing point of the linear line.

When the value of A is 0.11 or less, the photosensitive member depends little on a strength of electric field and the increasing change of an end portion of light-decay curve under a low electric field can be suppressed even after repetition use.

When the value of B is −5.9 or more, a sensitivity change is small at a low temperature. A layer can be made thick and the increase of a residual potential and the lowering of an initial surface potential can be suppressed. When the electrically conductive substrate having a small size is used and a copying speed is made high, it is more preferable that the value of A is 0.1 or less and that the value of B is −5 or more.

Further, a mobility (μ) and a space charge density (N) in the charge generating layer may be adjusted within a specified range in the present invention. Thereby charge carriers generated by light irradiation can be effectively prevented from accumulating in the charge generating layer with repetition use.

In particular, more stable charging properties can be given when the mobility is adjusted to $1\times10^{-8}$ $cm^2$/V.sec or more, preferably $5\times10^{-3}$ $cm^2$/V.sec under the electric field of $5\times10^{-5}$ V/cm and the space charge density is adjusted to $1\times10^{16}$ $cm^{-3}$ or less.

The space charge density (N) is a value determined by an electric field formed by charge carriers accumulated in the layer and has a following relationship:

$$d(1/c^2)/dv = 2/(\epsilon\epsilon_0 eN)$$

in which N is a space charge density, C is an electrostatic capacity per 1 $cm^2$ in the charge generating layer, V is a vias-voltage applied to the charge generating layer, e is a charge amount of an electron, ε is a dielectric constant in the charge generating layer, and $\epsilon_0$ is a vacuum dielectric constant As the value of the space charge density is larger, more charge carriers accumulate in the layer. Accordingly the space charge density is adjusted to $1\times10^{16}$ $cm^{-3}$ or less in the present invention. Thereby few electrical charges accumulate in the charge generating layer even after repetition use. Charging properties are stable. The space charge density can be given according to, for example, a low-frequency C-V method described by Allen J. Twarowsky and A. C. Albecht, J. Chem. Phys. 70, 2255 (1975).

As above mentioned, a laminated-type photosensitive member which can achieve the objects of the present invention can be provided when a photosensitive layer is formed on an electrically conductive substrate of a small size so that a charge transporting material and a binder resin may be selected to satisfy the relationship of the formula [I]. When a charge generating material and a binder resin are selected so that the mobility and the space charge density may be within a specified range in the charge generating layer, a photosensitive member having stable charging properties even after repetition use can be provided. The present invention is more effective for a photosensitive member of a laminated type having a charge generating layer and a charge transporting layer on an electrically conductive substrate in this order. Further the present invention is effective to be applied to such a copying system as electrostatic latent images are formed on an identical position of the photosensitive member at a 0.5 sec or less interval, particularly 0.3 sec or less interval.

A laminated type photosensitive member having a charge generating layer and a charge transporting layer on an electrically conductive substrate is explained in detail hereinafter.

In preparing a photosensitive member of a laminated type, a charge generating material may be deposited in vacuo on an electrically conductive substrate, or a solution containing a charge generating material dissolved in an adequate solvent or a solution containing a pigment and, if necessary, a binder resin dissolved or dispersed in an adequate solvent may be applied onto a substrate and dried. Thus a charge generating layer is formed.

Then a solution containing a charge transporting material and a binder resin is applied onto the charge generating layer to form a charge transporting layer. The coating of the charge generating layer and the charge transporting layer may be carried out by use of a conventional apparatus such as an applicator, a spray coater, a bar coater, a dipping coater, a roll coater and an doctor blade.

The charge generating layer is formed to have a layer thickness of 0.01 to 2 μm, preferably 0.1 to 1 μm. The charge generating material is contained in the charge generating layer at an amount of 0.1 to 10 parts by weight, preferably 0.2 to 5 parts by weight on the basis of 1 part be weight of the binder resin. If the amount is too low, sensitivity is poor.

If the amount is too high, chargeability is poor and mechanical strength is low.

A charge generating material useful for the present photosensitive layer is exemplified by organic pigments or dyes, such as bisazo pigments, triarylmethane dyes, thiazine dyes, oxazine dyes, xanthene dyes, cyanine coloring agents, styryl coloring agents, pyrylium dyes, azo dyes, quinacridone pigments, indigo pigments, perylene pigments, polycyclic quinone pigments, bisbenzimidazole pigments, indanthrone pigments, squalylium pigments and phthalocyanine pigments. Any other material is also usable insofar as it generates charge carriers very efficiently upon adsorption of light. In particular, bisazo pigments and phthalocyanine pigments are preferable.

Specific examples of the binder resins used with the charge generating material are thermoplastic resins such as saturated polyesters, polyamides, acrylic resins, ethylene-vinyl acetate copolymers, ion cross-linked olefin copolymers (ionomers), styrene-butadiene block copolymers, polyarylates, polycarbonates, vinyl chloride-vinyl acetate copolymers, cellulose esters, polyimides, styrol resins, polyacetals, phenoxy resins and other similar resins; thermosetting resins such as epoxy resins, urethane resins, silicone resins, phenolic resins, melamine resins, xylene resins, alkyd resins, thermosetting acrylic resins and other similar resins; photocuring resins; photoconductive resins such as poly(N-vinyl carbazoles), poly(vinyl pyrenes), poly (vinyl anthracenes) and other similar resins. Any of these resins may be used singly or in combination with other resins.

The above charge generating materials are dissolved or dispersed together with the above resin in an organic solvent, for example, alcohols such as methanol, ethanol and isopropanol, ketones such as acetone, methyl ethyl ketone and cyclohexanone, amides such as N,N-dimethyl formamide, N,N,-dimethyl acetamide, sulfoxides such as dimethyl sulfoxide, ethers such as tetrahydrofuran, dioxane and ethylene glycol monomethyl ether, esters such as methyl acetate and ethyl acetate, aliphatic halogenated hydrocarbons such as chloroform, methylene chloride, dichloroethylene, carbon tetrachloride and trichloroethylene, and aromatic hydrocarbons such as benzene, toluene, xylene, ligroin, monochlorobenzene and dichlorobenzene.

The obtained solution is applied onto an electrically conductive substrate, followed by drying, to form a charge generating layer.

An electrically conductive substrate useful in the present invention may be exemplified by a sheet or drum made of metal or alloy such as copper, aluminum, silver, iron and nickel; a substrate such as a plastic film on which the foregoing metal or alloy is adhered by a vacuum-deposition method or an electroless plating method and the like; a substrate such as a plastic film and paper on which an electroconductive layer is formed by applying or depositing electroconductive polymer, indium oxide, tin oxide etc. Generally, a cylindrical substrate is used. For example, a cut pipe in which an aluminum pipe which is processed by a pultrusion process after an extrusion process is cut and a about a 0.2–0.3 mm thickness portion of the outer surface of the pipe is cut off by means of a cutting apparatus, such as a diamond bit; a DI pipe in which an aluminum disk is deep-drawn to have a cup-like shape and then the outer surface is finished by ironing; an EI pipe in which an aluminum disk is impact-processed to have a cup-like shape and then the outer surface is finished by ironing; and an ED pipe in which aluminum is cold-drawn after an extrusion process; may be used. The surfaces of these pipes above mentioned may be further cut.

A charge transporting layer is formed on the charge generating layer to have a layer thickness of 27 to 70 μm, preferably 30 to 60 μm. The charge transporting material is contained in the charge transporting layer at an amount of 0.02 to 2 parts by weight, preferably 0.5 to 1.2 parts by weight on the basis of 1 part by weight of the binder resin. If the amount is too low, sensitivity is poor. If the amount is too high, chargeability is poor and mechanical strength of the photosensitive layer is low.

A charge transporting material useful for the preparation of the charge transporting layer is exemplified by hydrazone compounds, pyrazoline compounds, styryl compounds, triphenyl methane compounds, oxadiazole compounds, carbazole compounds, stilbene compounds, enamine compounds, oxazole compounds, triphenylamine compounds, tetraphenyl benzidine compounds and azine compounds. More particularly, p-diphenylaminobenzaldehyde-N,N-diphenyl hydrazone, 2-methyl-4-N,N-diphenylamino-β-phenylstilbene, α-phenyl-4-N,Ndiphenylaminostilbene, α-phenyl-4-N-phenyl-N-p-tolylvinylphenylaminostilbene and 1,1,4,4-bisdiethylaminotetraphenylbutadiene may be used. Polysilanes and other organic glass may be used. The charge transporting materials as above mentioned may be singly or in combination with other materials.

Specific examples of the binder resins used together with the charge transporting material are thermoplastic resins such as saturated polyesters, polyamides, acrylic resins, ethylene-vinyl acetate copolymers, ion cross-linked olefin copolymers (ionomers), styrene-butadiene block copolymers, polyarylates, polycarbonates, vinyl chloride-vinyl acetate copolymers, cellulose esters, polyimides, styrol resins, polyacetals, phenoxy resins and other similar resins; thermosetting resins such as epoxy resins, urethane resins, silicone resins, phenolic resins, melamine resins, xylene resins, alkyd resins, thermosetting acrylic resins and other similar resins; photocuring resins; photoconductive resins such as poly(N-vinyl carbazoles), poly(vinyl pyrenes), poly (vinyl anthracenes) and other similar resins. Any of these resins may be used singly or in combination with other resins.

A solvent which is used for the preparation of the charge transporting layer may be exemplified by an aromatic solvent such as benzene, toluene, xylene and chlorobenzene, a ketone such as acetone, methyl ethyl ketone and cyclohexanone, an alcohol such as methanol, ethanol and isopropanol, an ester such as ethyl acetate and ethyl Cellosolve, a halogenated hydrocarbon such as carbon tetrachloride, carbon tetrabromide, chloroform, dichloromethane and tetrachloroethane, an ether such as tetrahydrofuran and dioxane, an amide such as dimethyl formamide, dimethyl sulfoxide and diethyl formamide. These solvents may be used singly or in combination with other solvents.

Further the photosensitive layer may contain other conventional additives in order to improve coatability and flexibility or to restrain the accumulation of residual potential.

The photosensitive member of the present invention permits, in combination with the binder resin, the use of a plasticizer such as halogenated paraffin, polybiphenyl chloride, dimethyl naphthalene, dibuthyl phthalate and o-terphenyl, the use of an electron-attracting sensitizer such as chloranyl, tetracyanoquinodimethane, tetracyanoethylene, trinitro-fluorenone, dicyanobenzoquinone, tetrachlorophthalic anhydride, and 3,5-dinitrobenzoic acid, or the use of a sensitizer such as methyl violet, rhodamine B, cyanine dyes, pyrylium salts and thiapyrylium salts.

The photosensitive layer may contain an antioxidant in order to prevent deterioration caused by ozone. The antioxidant is exemplified by hindered phenol, hindered amine, paraphenylene diamine, hydroquinone, spirochroman, spiroindanone, hydroquinoline, a derivative thereof, organic phosphine compounds, and organic sulfur compounds.

The antioxidant is contained at an amount of 0.1 to 100 parts by weight, preferably 1 to 50 parts by weight, more preferably 5 to 30 parts by weight on the basis of 100 parts by weight of the charge transporting material.

A photosensitive member of the present invention may have an intermediate layer between the electrically conductive substrate and the photosensitive layer. Thereby, the improvement of adhesivity and coatability, the protection of the substrate and the restraint of charge injection into the photosensitive layer from the substrate can be achieved.

A material useful for forming the intermediate layer is exemplified by polyimides, polyamides, nitrocelluloses, poly(vinyl butyrals), poly(vinyl alcohol) and other similar compounds. A desirable thickness of the layer is 1 μm or less. A material having a low electrical resistance may be dispersed in the intermediate layer.

organic layer may contain an oxygen atom, a nitrogen atom, a halogen atom, and an atom in group III or V of the periodic table, if necessary.

A photosensitive member of the present invention may be applied, for example, not only to a copying machine but also to a printer or a facsimile which is equipped with a light source, such as a laser, a light emitting diode (LED), a LCD shutter and a Braun tube.

The present invention is further explained with reference to specific examples. It is, of course, not the intention hereby to limit the scope of the invention. In the examples, the term "part(s)" means "part(s) by weight" in so far as it is not explained particularly.

EXAMPLES 1 AND 2

As an electrically conductive substrate, a small aluminum drum having 26 mm diameter and 320 mm length was used in this example.

An azo compound represented by the following chemical formula:

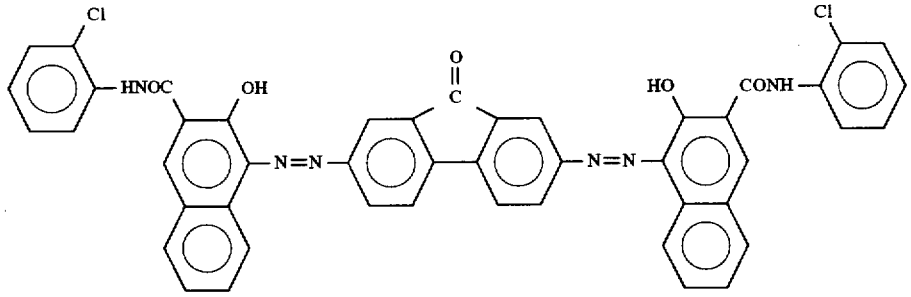

A photosensitive member of the present invention may have a surface protective layer. A material useful for forming the surface protective layer is exemplified by acrylic resins, polyaryl resins, polycarbonate resins, urethane resins, thermosetting resins, photocuring resins. These polymers may be used singly. A material of low electrical resistance, such as tin oxide, indium oxide and other similar compounds may be dispersed in the surface protective layer. A desirable thickness of the surface protective layer is 5 μm or less.

of 1 part, a polyester resin (Vylon 200; made by Toyo Boseki K.K.) of 1 part were dispersed in hexanone of 500 parts in a sand mill.

The obtained dispersion solution was diluted with tetrahydrofuran of 500 parts and applied onto the aluminum drum. Thus a charge generating layer was formed so that a thickness of the charge generating layer would be about 0.3 μm after drying.

Then a diamino compound represented by the following chemical formula:

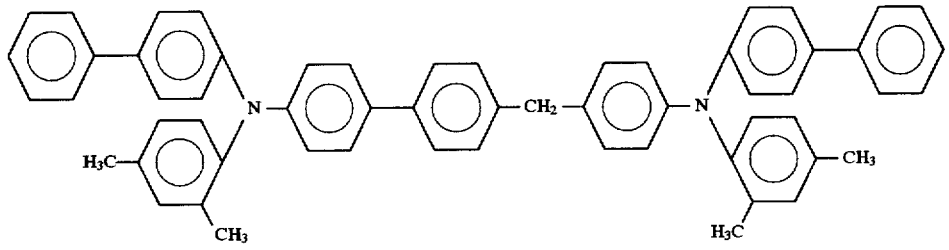

A plasma-polymerized organic layer may be applied to the surface protective layer. The plasma-polymerized of 50 parts, bisphenol Z polycarbonate of 50 parts, a cyano compound represented by the following formula:

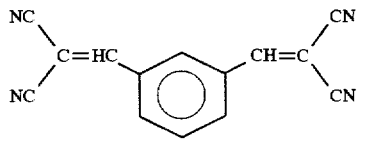

of 1.5 parts and di-ter-butyl-hydroxy-toluene of 4 parts were dissolved in dichloromethane. The obtained solution was applied onto the charge generating layer by a dipping method. Thus a charge transporting layer was formed so that a thickness of the charge transporting layer would be 30 μm (Example 1) or 40 μm (Example 2). Thus laminated type photosensitive members were obtained.

EXAMPLES 3 TO 5

As an electrically conductive substrate, a small aluminum drum having 45 mm diameter and 340 mm length was used in this example.

An azo compound represented by the following chemical formula:

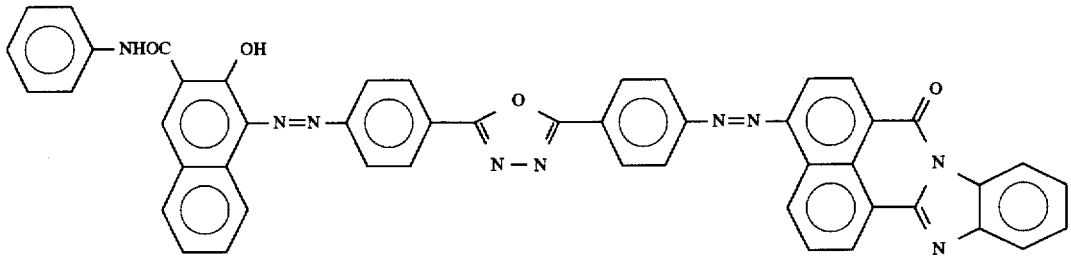

of 1 part, a phenoxy resin (pkHH; made by Union Carbide K.K.) of 0.5 parts and a poly-vinylbuthyral resin (#6000; made by Denka Kogyo K.K.) of 0.5 parts were dispersed in cyclohexanone of 500 parts in a sand mill. The obtained dispersion solution was diluted with 1,4-dioxane of 500 parts and applied onto the aluminum drum. Thus a charge generating layer was formed so that a thickness of the charge generating layer would be about 0.4 μm after drying.

Then a distyryl compound represented by the following chemical formula:

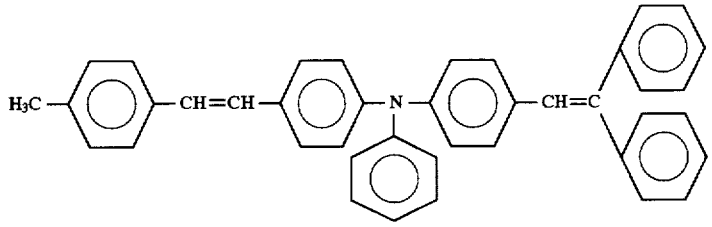

of 50 parts, bisphenol C polycarbonate of 60 parts, a cyano compound represented by the following formula:

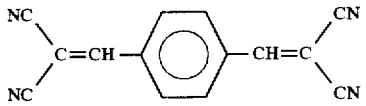

of 1.5 parts and di-ter-butyl-hydroxy-toluene of 4 parts were dissolved in 1,4-dioxane. The obtained solution was applied onto the charge generating layer by a dipping method. Thus a charge transporting layer was formed so that a thickness of the charge transporting layer would be 28 μm (Example 3), 35 μm (Example 4) or 43 μm (Example 5). Thus laminated type photosensitive members were obtained.

EXAMPLE 6

As an electrically conductive substrate, a small aluminum drum having 40 mm diameter and 300 mm length was used in this example.

An azo compound represented by the following chemical formula:

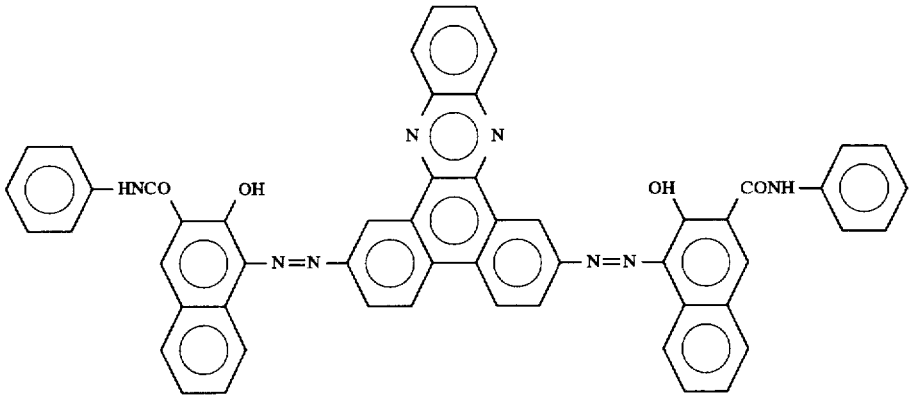

1 part, a phenoxy resin (PKHH; made by Union Carbide K.K.) of 0.5 parts and a poly-vinylbuthyral resin (BX-1; made by Sekisui Kagaku K.K.) of 0.5 parts were dispersed in cyclohexanone of 500 parts in a sand mill for 24 hours. The obtained dispersion solution was diluted with 1,4-dioxane of 500 parts and applied onto the aluminum drum. Thus a charge generating layer was formed so that a thickness of the charge generating layer would be about 0.2 μm after drying.

Then a diamino compound represented by the following chemical formula:

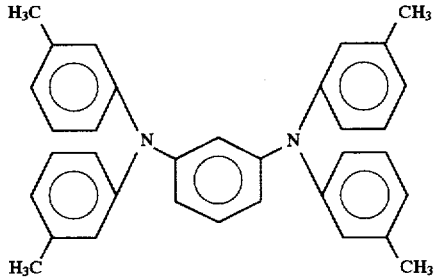

of 50 parts, polycarbonate of bisphenol Z type of 50 parts, a dicyano compound represented by the following formula:

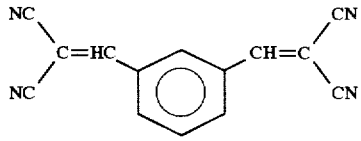

of 1.5 parts and di-ter-butyl-hydroxy-toluene of 4 parts were dissolved in dichloromethane. The obtained solution was applied onto the charge generating layer by a dipping method. Thus a charge transporting layer was formed so that a thickness of the charge transporting layer would be 35 μm. Thus a laminated type photosensitive member was obtained.

EXAMPLE 7

As an electrically conductive substrate, a small aluminum drum having 40 mm diameter and 300 mm length was used in this example.

A trisazo compound represented by the following chemical formula:

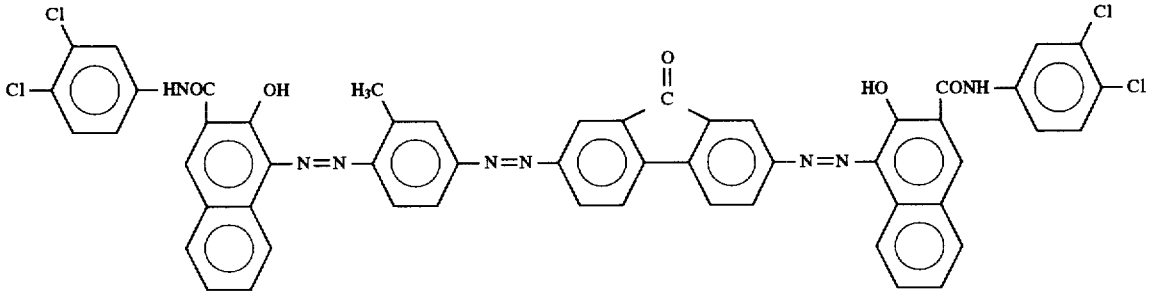

of 1 part, a phenoxy resin (PKHH; made by Union Carbide K.K.) of 0.5 parts and a poly-vinylbuthyral resin (BX-1; made by Sekisui Kagaku K.K.) of 0.5 parts were dispersed for 24 hours in cyclohexanone of 500 parts in a sand mill. The obtained dispersion solution was diluted with 1,4-dioxane of 500 parts and applied onto the aluminum drum. Thus a charge generating layer was formed so that a thickness of the charge generating layer would be about 0.2 μm after drying.

Then a diamino compound represented by the following chemical formula:

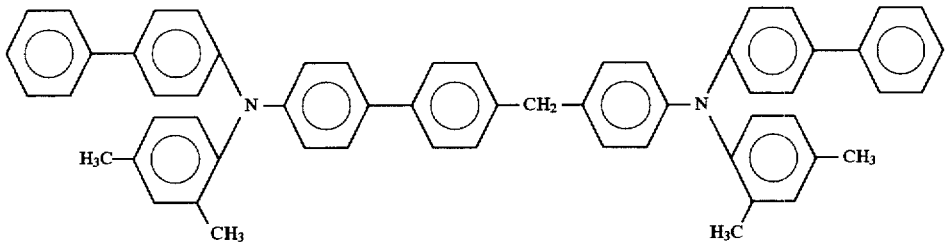

of 50 parts, polycarbonate of bisphenol Z type of 50 parts, a cyano compound represented by the following formula:

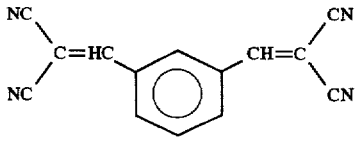

of 1.5 parts and di-ter-butyl-hydroxy-toluene of 4 parts were dissolved in dichloromethane. The obtained solution was applied onto the charge generating layer by a dipping method. Thus a charge transporting layer was formed so that a thickness of the charge transporting layer would be 35 μm. Thus a laminated type photosensitive members was obtained.

EXAMPLES 8 AND 9

A photosensitive member was prepared in a manner similar to Example 7 except that a layer thickness of the charge transporting layer was 40 μm (Example 8) or 45 μm (Example 9).

EXAMPLE 10

Titanylphthalocyanine of m-type of 0.5 parts, a poly(vinyl butyral) resin (6000C; made by Denki Kagaku Kogyo K.K.) of 0.5 parts were dispersed for 4 hours in tetrahydrofuran (THF) of 500 parts in a sand mill. The obtained dispersion solution was applied onto a small aluminum drum having 45 mm diameter and 340 mm length. Thus a charge generating layer was formed so that a thickness of the charge generating layer would be about 0.15 μm after drying.

Then a distyryl compound represented by the following chemical formula:

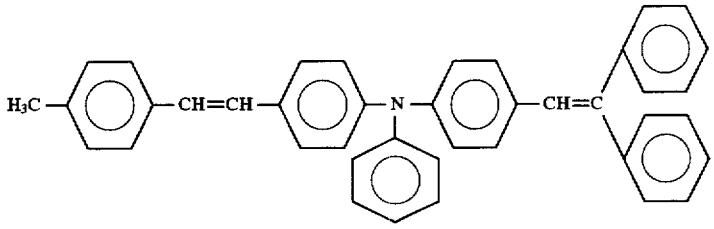

of 50 parts, polycarbonate of bisphenol C type of 60 parts, a cyano compound represented by the following formula:

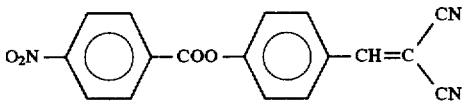

of 1.5 parts and di-ter-butyl-hydroxy-toluene of 4 parts were dissolved in 1,4-dioxane of 500 parts. The obtained solution was applied onto the charge generating layer. Thus a charge transporting layer was formed so that a thickness of the charge transporting layer would be 35 mm. Thus a laminated type photosensitive member having a two-layer photosensitive layer was obtained.

EXAMPLES 11 AND 12

A photosensitive member was prepared in a manner similar to Example 9 except that a layer thickness of the charge transporting layer was 43 μm (Example 11) or 50 μm (Example 12).

EXAMPLE 13

As an electrically conductive substrate, a small aluminum drum having 30 mm diameter and 280 mm length was used in this example.

An azo compound represented by the following chemical formula:

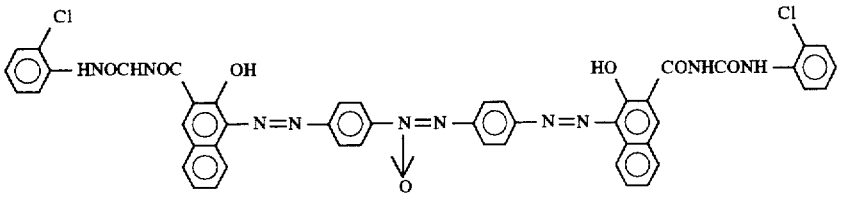

of 1 part, a polyester resin (Vylon 200; made by Toyo Boseki K.K.) of 0.5 parts and a polybutyral resin (BX-1; made by Sekisui Kagaku K.K.) of 0.5 parts were dispersed for 24 hours in cyclohexanone of 500 parts in a sand mill. The obtained dispersion solution was diluted with 1,4-dioxane of 500 parts and applied onto the aluminum drum. Thus a charge generating layer was formed so that a thickness of the charge generating layer would be about 0.3 μm after drying.

Then a diamino compound represented by the following chemical formula:

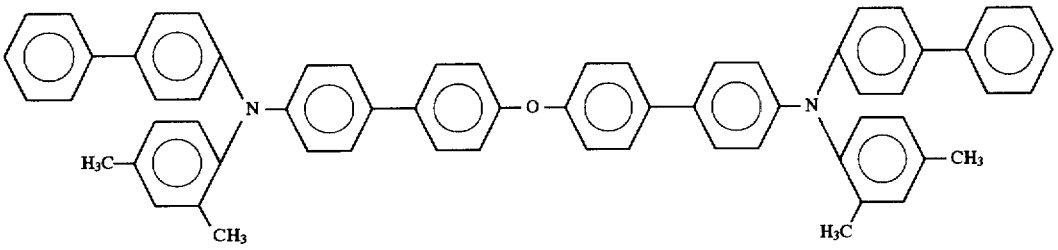

of 50 parts, polycarbonate of bisphenol Z type of 50 parts, a dicyano compound represented by the following formula:

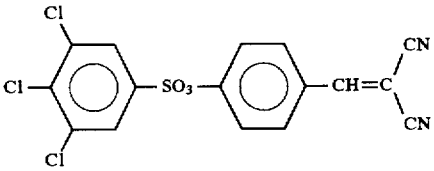

of 1.5 parts, di-ter-butyl-hydroxy-toluene of 4 parts and m-terphenyl of 5 parts were dissolved in dichloromethane. The obtained solution was applied onto the charge generating layer by a dipping method. Thus a charge transporting layer was formed so that a thickness of the charge transporting layer would be 40 μm. Thus a laminated type photosensitive member was obtained.

EXAMPLE 14

A photosensitive member was prepared in a manner similar to Example 13 except that a layer thickness of the charge transporting layer was 50 μm.

Comparative Example 1

A photosensitive member was prepared in a manner similar to Example 1 except that a hydrazone compound represented by the following formula:

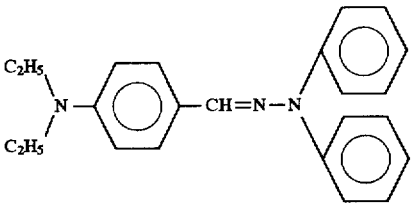

was contained in the charge transporting layer as a charge transporting material.

Comparative Example 2

A photosensitive member was prepared in a manner similar to Example 1 except that a hydrazone compound represented by the following formula:

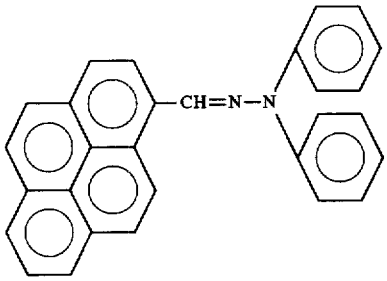

was contained in the charge transporting layer as a charge transporting material.

Comparative Example 3

A photosensitive member was prepared in a manner similar to Example 7 except that a hydrazone compound represented by the following formula:

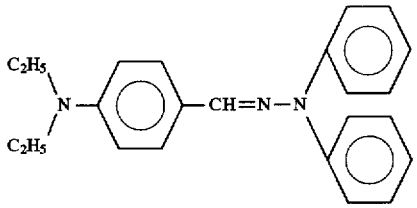

was contained in the charge transporting layer as a charge transporting material.

Comparative Example 4

A photosensitive member was prepared in a manner similar to Example 7 except that a hydrazone compound represented by the following formula:

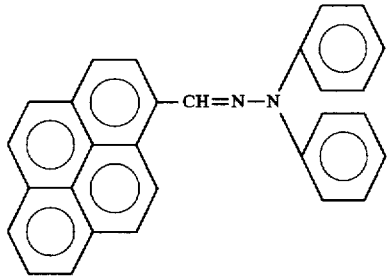

was contained in the charge transporting layer as a charge transporting material.

Evaluation

The obtained photosensitive members were evaluated by use of a tester for a photosensitive member shown in FIG. 1. While a photosensitive member (6) was revolved at a 200 mm/sec circumferential speed, it was corona-charged by a charger (5) at a −5 KV applying voltage power to measure an initial surface potential ($V_0$ (V)). Further an exposure amount for half reducing ($E_{1/2}$ (lux.sec)), a dark decreasing ratio ($DDR_1$(%)) and a residual potential (Vr(V)) were measured. The exposure amount for half reducing is the exposure amount required for the surface potential to be half the value of the initial surface potential. The dark decreasing ratio is the ratio of a reduced charge amount to the initial charge amount after the initially charged photosensitive member is left in the dark for 1 seconds. The residual potential is the one measured after the irradiation by an eraser (3) (50 lux.sec). The results are summarized in Table 1.

TABLE 1

| | $V_0$(V) | $E_{1/2}$(luxsec) | $DDR_1$(%) | $V_R$(V) |
|---|---|---|---|---|
| Ex1 | −660 | 0.6 | 2.0 | −5 |
| Ex2 | −680 | 0.5 | 1.8 | −5 |
| Ex3 | −670 | 0.6 | 2.2 | −2 |
| Ex4 | −680 | 0.5 | 1.7 | −5 |
| Ex5 | −680 | 0.5 | 1.5 | −7 |
| Ex6 | −675 | 0.8 | 2.1 | −9 |

TABLE 1-continued

| | $V_0$(V) | $E_{1/2}$(luxsec) | $DDR_1$(%) | $V_R$(V) |
|---|---|---|---|---|
| CE1 | −700 | 3.2 | 1.6 | −70 |
| CE2 | −670 | 0.7 | 2.1 | −20 |
| Ex7 | −670 | 0.6 | 2.0 | −2 |
| Ex8 | −680 | 0.5 | 1.8 | −5 |
| Ex9 | −690 | 0.4 | 1.5 | −5 |
| Ex10 | −660 | 0.7 | 2.3 | −3 |
| Ex11 | −675 | 0.6 | 1.9 | −5 |
| Ex12 | −690 | 0.4 | 1.6 | −7 |
| Ex13 | −680 | 0.5 | 2.0 | −3 |
| Ex14 | −690 | 0.4 | 1.4 | −6 |
| CE3 | −690 | 3.4 | 1.6 | −65 |
| CE4 | −670 | 0.8 | 2.3 | −35 |

Ex: Example
CE: Comparative Example

With respect to Examples 1 to 6 and Comparative Examples 1 and 2, a mobility of electrical charges in the photosensitive member was measured at 25° C. by the time of flight method. The results are summarized in Table 2.

TABLE 2

| | A | B |
|---|---|---|
| Ex1 | 0.08 | −4.70 |
| Ex2 | 0.08 | −4.70 |
| Ex3 | 0.09 | −4.88 |
| Ex4 | 0.09 | −4.88 |
| Ex5 | 0.09 | −4.88 |
| Ex6 | 0.11 | −5.32 |
| CE1 | 0.155 | −6.52 |
| CE2 | 0.131 | −5.89 |

Ex: Example
CE: Comparative Example
A and B are the same as explained in the formula [I]

The photosensitive members of Example 1 and Comparative example 1 were subjected to the following durability test. The revolution number of the drum was adjusted so that a time period between an irradiation process and a developing process would be 0.2 seconds. A copying process in which the irradiation power had 2 lux.sec was repeated 1,000 times under L/L environmental conditions (10° C., 35%). An initial surface potential ($V_0$ (V)), a potential at an irradiated portion ($V_i$ (V)) and a residual potential ($V_R$ (V)) were measured. The results are summarized in Table 3. V'0 (V), V'i (V) and $V'_R$ (V) in Table 3 represent respectively a value after 1,000 times repetition.

TABLE 3

| | initial | | | after 1000 times of copy | | |
|---|---|---|---|---|---|---|
| | $V_0$ (V) | $V_i$ (V) | $V_R$ (V) | $V'_0$ (V) | $V'_i$ (V) | $V'_R$ (V) |
| Ex 1 | −670 | −20 | −10 | −660 | −20 | −15 |
| Ex 6 | −675 | -50 | −9 | −650 | −70 | −25 |
| CE 1 | −650 | −105 | −50 | −550 | −210 | −110 |

Ex: Example
CE: Comparative Example

With respect to Examples 7 to 14 and Comparative Examples 3 to 4, a mobility of electrical charges in the charge transporting layer and the charge generating layer was measured similarly as above mentioned. The results are summarized in Table 4. A space charge density was also measured by the C-V method above mentioned. The results are summarized in Table 4.

TABLE 4

| | Charge generating layer | | Charge transporting layer | |
|---|---|---|---|---|
| | Mobility | space charge | Coefficient of Mobility | |
| | ($cm^2/V \cdot sec$) | density ($cm^{-3}$) | A | B |
| EX 7 | $1 \times 10^{-7}$ | $0.7 \times 10^{15}$ | 0.08 | −4.70 |
| EX 8 | $1 \times 10^{-7}$ | $0.7 \times 10^{15}$ | 0.08 | −4.70 |
| EX 9 | $1 \times 10^{-7}$ | $0.7 \times 10^{15}$ | 0.08 | −4.70 |
| EX 10 | $3 \times 10^{-7}$ | $5 \times 10^{15}$ | 0.09 | −4.88 |
| EX 11 | $3 \times 10^{-7}$ | $5 \times 10^{15}$ | 0.09 | −4.88 |
| EX 12 | $3 \times 10^{-7}$ | $5 \times 10^{15}$ | 0.09 | −4.88 |
| EX 13 | $5 \times 10^{-7}$ | $2 \times 10^{15}$ | 0.08 | −4.60 |
| EX 14 | $5 \times 10^{-7}$ | $2 \times 10^{15}$ | 0.08 | −4.60 |
| CE 3 | $1 \times 10^{-7}$ | $0.7 \times 10^{15}$ | 0.155 | −6.52 |
| CE 4 | $1 \times 10^{-7}$ | $0.7 \times 10^{15}$ | 0.131 | −5.89 |

Ex: Example
CE: Comparative Example

The photosensitive members of Examples 7, 10 and 13 and Comparative examples 3 and 4 were subjected to the following durability test. The revolution number of the drum was adjusted so that a time period between an irradiation process and a developing process would be 0.2 seconds. A copying process in which the irradiation power had 2 lux.sec was repeated 10,000 times under L/L environmental conditions (10° C., 35%). An initial surface potential ($V_O$ (V)), a potential at an irradiated portion ($V_i$ (V) ) and a residual potential ($V_R$ (V)) were measured. The results are summarized in Table 5. $V'_O$, $V'_i$ and $V'_R$ in Table 5 represent respectively a value after 10,000 times repetition.

Further the photosensitive members obtained in Example 1 and Example 7 were respectively installed in a copying machine (EP-3150; made by Minolta Camera) and subjected to a durability test with respect to 50,000 times of copy. A lowering of the surface potential was small and excellent copy images could be formed without deterioration of image quality.

TABLE 5

| | initial | | | after 10,000 times of copy | | |
|---|---|---|---|---|---|---|
| | $V_O$ (V) | $V_i$ (V) | $V_R$ (V) | $V'_O$ (V) | $V'_i$ (V) | $V'_R$ (V) |
| Ex 7 | −670 | −20 | −5 | −660 | −20 | −10 |
| Ex 10 | −660 | −30 | −5 | −640 | −35 | −10 |
| Ex 13 | −680 | −15 | −5 | −670 | −20 | −15 |
| CE 3 | −690 | −120 | −50 | −560 | −240 | −120 |
| CE 4 | −670 | −60 | −35 | −580 | −150 | −80 |

Ex: Example
CE: Comparative Example

What is claimed is:

1. A method for developing an electrostatic latent image formed on a photosensitive member comprising forming an electrostatic latent image on an identical position of a laminated photosensitive member at a 0.5 second or less interval and, developing the electrostatic latent image, wherein the photosensitive member comprises a charge generating layer containing an organic charge generating material, said charge generating layer having a mobility in the charge generating layer of at least $1\times10^{-8}cm^2/V.sec$ under an electrical field of $5\times10^5V/cm$ and a space charge density of the charge generating layer of $1\times10^{16}cm^{-3}$ or less; a charge transporting layer having a thickness of at least 35 μm and containing an organic charge transporting material, said charge transporting layer having a mobility (μ) of electrical charges satisfying the following formula:

$$\log \mu = A \times E^{1/2} + B \quad [I]$$

in which E is an electrical field (V/μm), A represents a value of 0.11 or less and B is −5.9 or more; and a cylindrical substrate having a drum size of 50 mmΦ or less.

2. The method of claim 1, wherein the charge generating layer has a layer thickness of 2 μm or less.

3. The method of claim 2, wherein the transporting layer has a thickness in the range of 35–60 μm.

4. The method of claim 1, wherein the charge generating layer is formed on the charge transporting layer.

5. The method of claim 1, wherein the charge generating material is contained in the charge generating layer at an amount of 0.1 to 10 parts by weight on the basis of 1 part by weight of a binder resin.

6. The method of claim 1, wherein the charge transporting material is contained in the charge transporting layer at an amount of 0.02 to 2 parts by weight on the basis of 1 part by weight of a binder resin.

7. The method of claim 1, wherein A is 0.1 or less and B is −5 or more.

8. The method of claim 1, wherein the mobility of charges in a charge generating layer is $5\times10^{-8}$ $cm^2/V.sec$ or more under an electric field of $5\times10^5V/sec$.

9. The method of claim 1, wherein the charge generating material is selected from the group consisting of bisazo pigments, triarylmethane dyes, thiazine dyes, oxazine dyes, xanthene dyes, cyanine pigments, styryl pigments, pyrilium pigments, azo pigments, quinacridone pigments, indigo pigments, perylene pigments, polycyclic quinone pigments, bisbenzimidazole pigments, indanthrone pigments and squalylium pigments.

10. The method of claim 1, wherein the charge generating material is a trisazo compound of the formula:

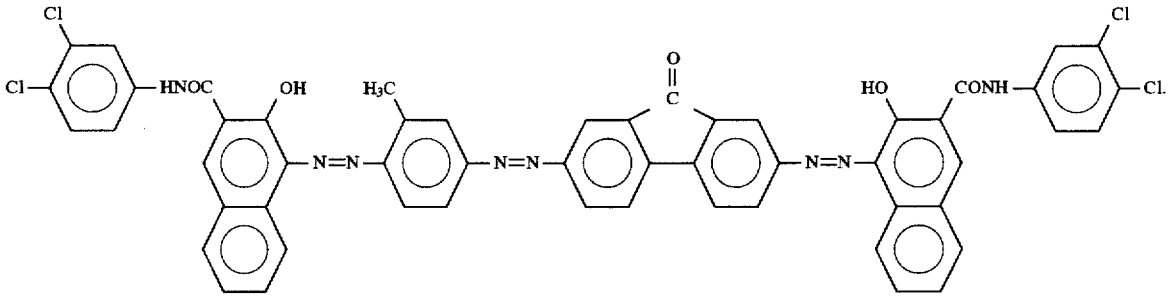

11. The method of claim 1, wherein the charge transporting material is selected from the group consisting pyrazoline compounds, styryl compounds, triphenylmethane compounds, oxadiazole compounds, carbazole compounds, stilbene compound, enamine compounds, oxazole compounds, triphenylamine compounds, tetraphenyl benzidine compounds and azine compounds.

12. The method of claim 1, wherein the charge transporting material is a styryl compound.

13. The method of claim 1, wherein the charge transporting material is a triphenyl compound.

* * * * *